US009726433B2

(12) United States Patent
Voschezang et al.

(10) Patent No.: US 9,726,433 B2
(45) Date of Patent: Aug. 8, 2017

(54) HEATING

(71) Applicant: URENCO Limited, Stoke Poges Buckinghamshire (GB)

(72) Inventors: Herald Voschezang, Stoke Poges Buckinghamshire (GB); Ferdinand Rose, Stoke Poges Buckinghamshire (GB)

(73) Assignee: URENCO Limited, Stoke Poges Buckinghamshire (GB)

( * ) Notice: Subject to any disclaimer, the term of this patent is extended or adjusted under 35 U.S.C. 154(b) by 923 days.

(21) Appl. No.: 13/688,538

(22) Filed: Nov. 29, 2012

(65) Prior Publication Data

US 2013/0133860 A1 May 30, 2013

(30) Foreign Application Priority Data

Nov. 29, 2011 (EP) ..... 11400055

(51) Int. Cl.

| | |
|---|---|
| ***F28D 5/00*** | (2006.01) |
| ***F24H 9/12*** | (2006.01) |
| ***F24D 3/10*** | (2006.01) |
| ***F24H 9/20*** | (2006.01) |
| ***F28D 7/10*** | (2006.01) |
| ***F28F 1/24*** | (2006.01) |

(52) U.S. Cl.

CPC ..... *F28D 5/00* (2013.01); *F24D 3/1008* (2013.01); *F24H 9/126* (2013.01); *F24H 9/2021* (2013.01); *F28D 7/106* (2013.01); *F28F 1/24* (2013.01)

(58) Field of Classification Search

CPC . F24H 1/52; F22B 1/025; F28D 7/106; F28D 5/00; F28F 1/24

USPC ..... 122/33, 18.1; 165/104.14, 80.2, 80.4, 165/104.19, 104.13

See application file for complete search history.

(56) References Cited

U.S. PATENT DOCUMENTS

| | | | | |
|---|---|---|---|---|
| 277,534 | A * | 5/1883 | Bailey | 196/119 |
| 3,341,122 | A * | 9/1967 | Whittell, Jr. | 237/8 R |
| 3,446,188 | A * | 5/1969 | Nozawa | F22B 1/063 122/32 |
| 4,244,697 | A * | 1/1981 | Vietzke et al. | 23/294 R |

(Continued)

FOREIGN PATENT DOCUMENTS

| | | |
|---|---|---|
| AT | 375165 B | 7/1984 |
| DE | 1604093 B | 9/1970 |

(Continued)

OTHER PUBLICATIONS

European Search Report of EP11400055, dated May 4, 2012.

(Continued)

*Primary Examiner* — Avinash Savani
*Assistant Examiner* — Rabeeul Zuberi
(74) *Attorney, Agent, or Firm* — Banner & Witcoff, Ltd.

(57) ABSTRACT

A heating apparatus comprising a heating chamber in which a heater is configured to heat a heating liquid, a heat exchanger configured to receive the heating liquid from the heating chamber and to transfer heat energy from the heating liquid to a separate heating fluid and a pressure regulator configured to control a pressure inside the heating chamber, wherein the regulator is coupled at a first side to a pressure in the heating chamber and at a second side to atmospheric pressure outside the apparatus. A method of heating is also described.

16 Claims, 4 Drawing Sheets

(56) References Cited

U.S. PATENT DOCUMENTS

| | | | | | |
|---|---|---|---|---|---|
| 4,338,874 | A * | 7/1982 | Shaw et al. | 114/50 | |
| 4,495,899 | A * | 1/1985 | Carberry | 122/504 | |
| 5,092,226 | A * | 3/1992 | McCloskey | F23J 13/08 | 110/184 |
| 5,101,772 | A * | 4/1992 | Bruhn | F22B 1/06 | 110/210 |
| 5,348,623 | A * | 9/1994 | Salmon | 203/1 | |
| 5,507,142 | A * | 4/1996 | Wintonyk | 60/39.63 | |
| 2008/0184589 | A1* | 8/2008 | Shivvers | F26B 3/08 | 34/504 |

FOREIGN PATENT DOCUMENTS

| | | | |
|---|---|---|---|
| DE | 2730688 | A1 | 1/1979 |
| EP | 0931988 | A2 | 7/1999 |

OTHER PUBLICATIONS

Ernst-Rudolf Schramek: "AusdehnungsgefaBe und Druckhalteeinrichtungen" In: Taschenbuch fur Heizung and Klimatechnik, Jan. 1, 2001, Oldenbourg Industrieverlag Munchem, pp. 846-855.

Ernst-Rudolf Schramek: "Sicherheitsventile" In: Taschenbuch fur Heizung und Klimatechnik, Jan. 1, 2001, Oldenbourg Industrieverlag, Munchen, pp. 854-856.

* cited by examiner

HEATING

FIELD

The invention relates to heating a heating fluid by transferring heat energy from a heated liquid to the heating fluid. Particularly, but not exclusively, the invention relates to heating the liquid in a pressure regulated chamber.

BACKGROUND

In a uranium enrichment facility, a feed station feeds uranium material, such as uranium hexafluoride, into an enrichment apparatus. The uranium material is heated before being fed into the facility.

SUMMARY

According to the invention, there is provided a heating apparatus comprising: a heating chamber in which a heater is configured to heat a heating liquid; a heat exchanger configured to receive the heating liquid from the heating chamber and to transfer heat energy from the heating liquid to a separate heating fluid; and a pressure regulator configured to control a pressure inside the heating chamber, wherein the regulator is coupled at a first side to a pressure in the heating chamber and at a second side to atmospheric pressure outside the apparatus.

The pressure regulator may be configured to vent gaseous heating liquid from the heating chamber upon a pressure in the heating chamber reaching a predetermined value.

The pressure regulator may be configured such that a difference between the pressure inside the heating chamber and the atmospheric pressure outside the apparatus causes the pressure regulator to open to vent evaporated gaseous heating liquid from the heating chamber.

The pressure regulator may comprise a seal which is configured to be automatically opened by a pressure differential between the pressure in the heating chamber and the atmospheric pressure outside the apparatus, thereby opening a channel between the heating chamber and the atmosphere outside the apparatus.

The pressure regulator may comprise an inlet open to the heating chamber and an outlet open to atmospheric pressure outside the apparatus.

A difference between the pressure inside the heating chamber and the atmospheric pressure outside the apparatus may cause the liquid heating fluid to flow from the heating chamber through the inlet towards the outlet.

The pressure regulator may comprise a U-bend between the inlet and outlet for containing a body of liquid heating fluid.

The heat exchanger may comprise a heating surface which is thermally coupled to a heating liquid channel to receive heat from the heating liquid.

The heat exchanger may comprise a heating fluid channel configured to direct the heating fluid over the heating surface to receive heat from the heating surface.

The apparatus may comprise a uranium material heating chamber configured to receive heated heating fluid from the heat exchanger and to heat a uranium material container therein The uranium material heating chamber may be configured to supply cooled heating fluid back to the heat exchanger.

The heating liquid may comprise water.

Evaporation of the heating liquid in the heating chamber may prevent further heating of the heating liquid and heating fluid.

Evaporation of the heating liquid in the heating chamber may lower a surface of the heating liquid below the heater in the chamber and thereby prevent direct contact between the heating liquid and the heater.

According to the invention, there may be provided a method of heating comprising: heating a heating liquid in a heating chamber; receiving the heating liquid in a heat exchanger and transferring heat energy from the heating liquid to a separate heating fluid; and regulating a pressure inside the heating chamber by coupling a pressure in the heating chamber to atmospheric pressure outside the apparatus via a pressure regulator.

For exemplary purposes only, embodiments of the invention are described below with reference to the accompanying figures in which:

DETAILED DESCRIPTION

Figure 1:
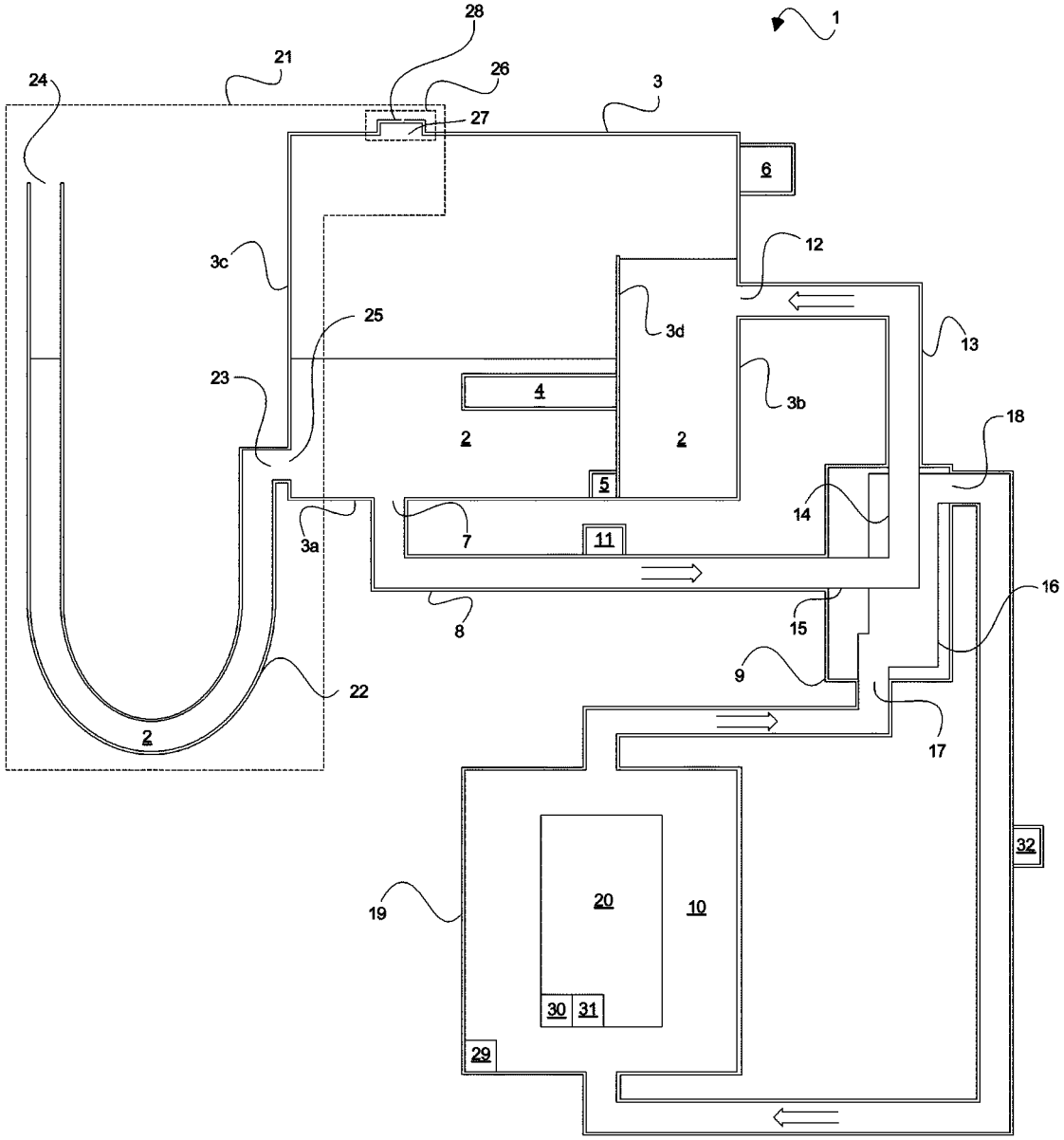
FIG. 1 is a schematic illustration of a heating apparatus for heating a primary heating fluid and transferring heat from the primary heating fluid to a secondary heating fluid for heating a uranium material container.

An apparatus 1 configured to heat a uranium material container is illustrated in FIG. 1. The apparatus 1 ensures that the maximum attainable temperature of the uranium material container is limited to a threshold by using an inherently safe heating mechanism.

The apparatus 1 comprises a heating region configured to heat a primary heating fluid 2. The primary heating fluid 2 comprises an evaporable liquid, such as water. As shown in FIG. 1, the heating region comprises a heating chamber 3 in which liquid primary heating fluid 2 is heated. The heating chamber 3 may comprise one or more fill lines for obtaining a suitable fill level of the liquid primary heating fluid 2 in the chamber 3. The heating region also comprises a heater 4 which is configured to heat the liquid primary heating fluid 2 inside the chamber 3. The heater 4 may, for example, comprise an electrically-powered heating element arranged to transfer heat energy to the liquid primary heating fluid 2. The heater 4 is coupled to a power supply (not shown) and is configured to receive power from the power supply in order to heat the liquid 2. The heater 4 may be located in such a way that, if the liquid heating fluid 2 starts to vaporize due to operation of the heater 4, contact between the heater 4 and the liquid heating fluid 2 is lost thereby preventing further heating of the liquid heating fluid 2. The arrangement of the heater 4 is described in more detail below.

A temperature sensor 5 is included inside the chamber 3 and is configured to sense the temperature of the liquid primary heating fluid 2 inside the chamber 3. The temperature sensor 5 may be integrated with the heater 4, as shown in FIG. 1. The temperature sensor 5 is configured to communicate indications of temperature to the heater 4 via a communicative coupling so that the heater 4 can control the temperature of the liquid primary heating fluid 2 inside the chamber 5. Control of the liquid temperature by the heater 4 may comprise maintaining the temperature of the liquid primary heating fluid 2 inside the chamber 3 at a particular temperature value or within a particular range of temperature values. For example, the heater 4 may be configured to vary the rate of heat transfer to the liquid primary heating fluid 2 in dependence of a signal received from the control unit 6.

The heating chamber 3 comprises an inlet and an outlet through which the liquid primary heating fluid 2 can respectively enter and exit the heating chamber 3, as described below.

A first aperture 7 comprises an exit through which the liquid primary heating fluid 2 can flow out of the heating chamber 3. As shown in FIG. 1, the exit 7 may be located in a floor 3*a* of the heating chamber 3 so that the liquid primary heating fluid 2 flows out of the chamber 2, for example under gravity. An exit conduit 8 is connected to the exit 7 so that the liquid 2 which exits the chamber 3 through the exit 7 enters the conduit 8. The conduit 8 may comprise a pipe or any other suitable means of directing the liquid primary heating fluid 2. The exit conduit 8 is configured to guide the liquid primary heating fluid 2 which has entered the conduit 8 from the heating chamber 3 to a heat exchanger 9, also illustrated in FIG. 1, where heat is transferred from the liquid primary heating fluid 2 to a secondary heating fluid 10. The secondary heating fluid 10 may comprise a gas, such as air, as explained in more detail below. A pump 11 may be provided to pump the liquid primary heating fluid 2 through the exit conduit 8 from the heating chamber 3 to the heat exchanger 9. In terms of its relative position in the apparatus 1, the heat exchanger 9 may be at the same vertical level as the heating chamber 3. Alternatively, the heat exchanger 9 may be at a higher vertical level than the heating chamber 3.

Still referring to FIG. 1, a second aperture 12 of the heating chamber 3 comprises an entrance through which the liquid primary heating fluid 2 can re-enter the chamber 3 from the heat exchanger 9. The entrance 12 may be located in a substantially upright or vertical wall 3*b* of the heating chamber 3. For example, the entrance 12 may be provided at a location in the wall 3*b* which is at approximately half of the height of the heating chamber 3. An entrance conduit 13 is connected to the entrance 12 to feed liquid primary heating fluid 2 into the heating chamber 3 through the entrance 12. As with the exit conduit 8 previously described, the entrance conduit 13 may comprise a pipe or any other suitable means of directing the liquid primary heating fluid 2. At its opposite end to the chamber entrance 12, the entrance conduit 13 is connected to receive liquid primary heating fluid 2 from the heat exchanger 9 so that liquid primary heating fluid 2 flowing out of the heat exchanger 9 is guided by the entrance conduit 13 through the entrance 12 and into the heating chamber 3.

In order to regulate the flow of liquid primary heating fluid 2, the entrance conduit 13 may be configured to feed the primary heating liquid 2 from the heat exchanger 9 into a heating liquid receiving compartment of the heating chamber 3. The heating liquid receiving compartment is separated from the heater 4 by an internal wall 3*d* of the chamber 3 so that liquid 2 in the liquid receiving compartment is not substantially heated by the heater 4. In order for the liquid 2 to be heated, it must overflow the internal wall into a larger heating compartment of the chamber 3, in which the heater 4 is present. In terms of its location relative to other components of the apparatus 1, the vertical level of the internal wall 3*d* may be approximately the same as the vertical level of the heat exchanger 9. In this way the liquid primary heating fluid 2 in the receiving compartment is at approximately the same vertical level as the heat exchanger 9. The two may be arranged so that liquid primary heating fluid 2 in the receiving compartment ensures that the heat exchanger 9 stays filled with liquid primary heating fluid 2 even when the liquid primary heating fluid 2 evaporates in the heating compartment. This is described in more detail further below.

Figure 2:
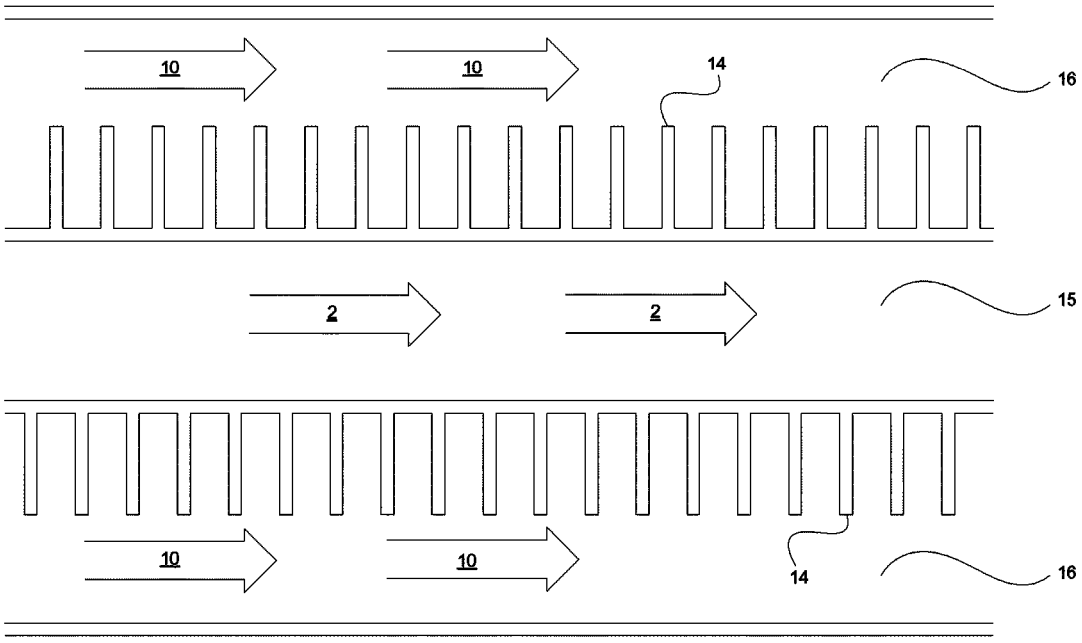
FIG. 2 is a schematic illustration of a heat exchanger for transferring heat from the primary heating fluid to the secondary heating fluid.
Figure 3:
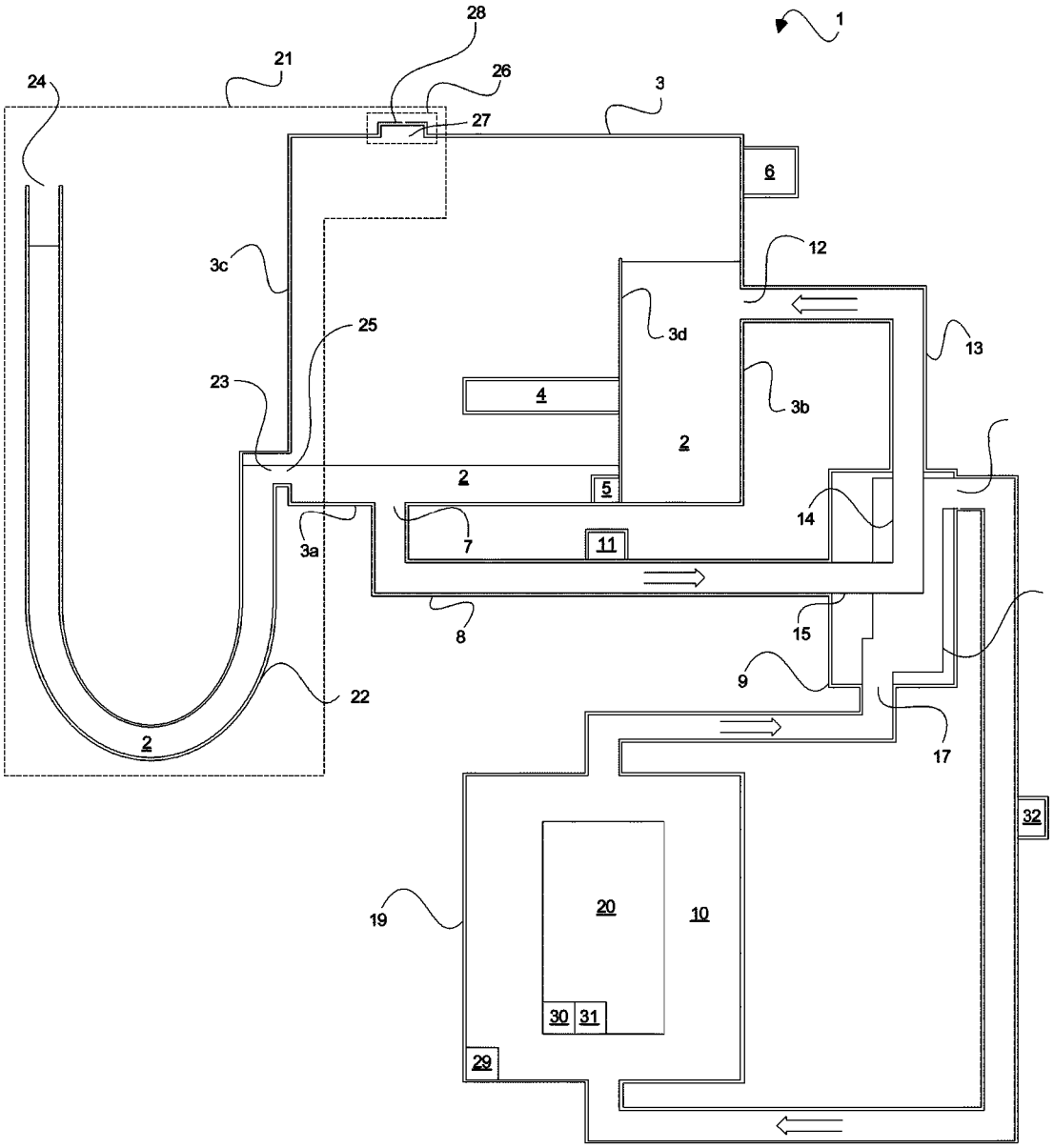
FIG. 3 is a schematic illustration of a pressure regulator when releasing pressure from a primary heating fluid heating chamber.

As mentioned previously, the heat exchanger 9 is configured to transfer heat from the liquid primary heating fluid 2 to the secondary heating fluid 10. For example, the heat exchanger 9 may comprise a heating surface 14 which is heated by the liquid primary heating fluid 2 and is exposed to the secondary heating fluid 10 so that heat energy transfers from the heated surface 14 to the secondary heating fluid 10. Referring to FIG. 2, the heating surface 14 may be arranged so that the secondary heating fluid 10 flows over the heating surface 14 inside the heat exchanger 9, thereby causing an increase in temperature of the secondary heating fluid 10.

The heating surface 14 may comprise one or more fins and is arranged to be heated by the liquid primary heating fluid 2. For example, the heating surface 14 may be thermally coupled to a primary heating fluid channel 15 through which the liquid primary heating fluid 2 flows through the heat exchanger 9. The heating surface 14 may optionally be heated through direct contact with the liquid primary heating fluid 2 in the channel 15. Alternatively, the heating surface 14 may be otherwise thermally coupled to the heating fluid channel 15 via a heat conductive member in order that heat energy from the liquid primary heating fluid 2 transfers to the heating surface 14. The primary heating fluid channel 15 is continuously fed with liquid primary heating fluid 2 from the heating chamber 3 via the exit conduit 8 previously described, so that the heat exchanger 9 continues to heat the secondary heating fluid 10 with heat energy from the liquid primary fluid 2.

Referring to FIG. 2, for example, the primary heating fluid channel 15 may comprise a primary fluid conduit such as a pipe, or any other suitable type of primary fluid directing means, which is arranged to receive liquid primary heating fluid 2 from the exit conduit 8 and to transfer heat energy from the received liquid primary heating fluid 2 to the secondary heating fluid 10 via a thermal coupling with the heating surface 14. A continuous flow of the secondary heating fluid 10 passes over the heating surface 14 to cause the heat transfer. The primary heating fluid channel 15 is configured to output cooled liquid primary heating fluid 2 to the heating chamber 3 via the entrance conduit 13 described above.

As illustrated in FIG. 2, the heat exchanger 9 may comprise a secondary heating fluid channel 16 through which the secondary heating fluid 10 is caused to flow during the heating process. As previously described, the secondary heating fluid 10 may comprise a gas, such as air or another suitable heat transfer gas, which may be blown over the heating surface 14 using one or more fans or other fluid directing units in the secondary heating fluid channel 16. Referring back to FIG. 1, an entrance 17 of the secondary heating fluid channel 16 is arranged to receive cooled secondary heating fluid 10 and an exit 18 of the secondary heating fluid channel 16 is arranged to output heated secondary heating fluid 10. Located between the entrance 17 and the exit 18 of the channel 16 is the heating surface 14 previously described, which is arranged to increase the temperature of the secondary heating fluid 10 as the secondary fluid 10 passes over the heating surface 14.

The secondary heating fluid 10 may be directed into the entrance 17 of the secondary heating fluid channel 16 of the heat exchanger 9 from a heating chamber 19 in which the secondary fluid 10 has been used to heat a uranium material container 20 such as a cylinder. For example, as illustrated in FIG. 1, the secondary heating fluid 10 may be directed into the channel 16 from an exit of the heating chamber 19. In a corresponding fashion, secondary heating fluid 10 output from the exit 18 of the secondary heating fluid channel 16 in the heat exchanger 9 may be directed into an entrance of the heating chamber 19 to further heat the uranium material container 20. The secondary heating fluid 10 flows through the chamber 19 from the channel exit 18 to continuously heat the uranium material container 20 therein. After leaving the heating chamber 19 the secondary heating fluid 10 is transferred back into the heat exchanger 9 via the inlet 17 of the heat exchanger 9 to be re-heated by the heating surface 14. The uranium material in the container 20 may comprise uranium hexafluoride which, upon being heated by the secondary heating fluid 10 in the chamber 19, may be converted from a solid state into a gaseous state. An outlet of the container 20 is connected to supply the heated uranium hexafluoride from the container 20 into uranium material enrichment equipment. As shown in FIG. 1, the heating chamber 19 comprises a sensor 29 configured to monitor the temperature of the chamber 19. Likewise, the container 20 may comprise a sensor 30 configured to monitor the temperature of the container 20. For example, the sensor 30 may be configured to monitor a temperature of a wall of the container 20. The container 20 may also comprise a sensor 31 configured to monitor the internal pressure in the cylinder 20. The temperature sensors 29, 30 of the heating chamber 19 and container 20 are configured to communicate the sensed temperature values in the chamber 19 and container 20 to the control unit 6. The pressure sensor 31 of the container 20 is also configured to communicate the sensed pressure values in the container 20 to the control unit 6. The control unit 6 is configured to use the information received from these sensors 29, 30, 31 to control the operation of the heater 4, as described further below. The control unit 6 may also be configured to use the information received from the sensors 29, 30, 31 to control the operation of the pump 11 and one or more fans 32 configured to cause the secondary heating fluid 10 to circulate to and from the uranium material heating chamber 19.

Referring again to FIG. 1, during use the primary heating chamber 3 is partially filled with the liquid primary heating fluid 2. The heater 4 is partially or fully submerged in the primary heating liquid 2 so that the heating element is at least partially below the surface of the liquid 2 in the heating chamber 3. In this way, activation of the heater 4 by the controller 6 causes heating of the primary heating fluid 2 by direct contact with the heater 4. The primary heating liquid 2 continuously flows out of the heating chamber 3 into the heat exchanger 9 and from the heat exchanger 9 back into the heating chamber 3, as previously described, so that the amount of primary heating liquid 2 present in the heating chamber 3 remains approximately constant. This action continuously heats the secondary heating fluid 10 in the heat exchanger 9.

The liquid primary heating fluid 2 re-entering the heating chamber 3 from the heat exchanger 9 may be significantly cooler in temperature than the liquid primary heating fluid 2 exiting the heating chamber 3 through the exit 7, due to the loss of heat energy which takes place in the heat exchanger 9. The temperature difference between the heating liquid 2 entering the heating chamber 3 through the entrance 12 and the desired temperature for heating liquid 2 in the chamber 3 may require the heater 4 to continuously heat the liquid 2 in the chamber 3 in order to maintain the desired temperature. An example of a desired temperature for the liquid primary heating fluid 2 inside the chamber 3 is between approximately forty and eighty degrees Celsius, although other temperatures below the boiling point of the primary heating liquid 2 could also be used.

As indicated previously, the heating power output of the heater 4 is controlled by the control unit 6. The control unit 6 may control the power output of the heater 4 in dependence of temperature measurements received from the temperature sensors 29, 30 in the container heating chamber 19 and the container 20 in order to maintain desired temperatures in the heating chamber 19 and the container 20. The control unit 6 may also control the power output of the heater 4 in dependence of pressure measurements received from the pressure sensor 31 in the container 20 to maintain a desired pressure in the container 20. In addition, the control unit 6 may control the power output of the heater 4 in dependence of measurements received from the sensor 5 indicating the temperature of the liquid primary heating fluid 2 inside the heating chamber 3. For example, the control unit 6 may be configured to compare the pressure and temperature measurements received from the sensors 5, 29, 30, 31 with predetermined threshold values and to reduce or zero the heating power output of the heater 4 if one of the measurements exceeds a threshold value. One or more threshold values may be stored in the control unit 6 for each of the sensors 5, 29, 30, 31. If none of the temperature and pressure measurements received from the sensors 5, 29, 30, 31 exceed the predetermined threshold limits, the control unit 6 may be configured to switch on the heater 4 and/or maintain or increase the heating power output of the heater 4 in order to heat the liquid primary heating fluid 2 and thereby heat the secondary heating fluid 10 and container 20. An example threshold value for the temperature of the secondary fluid 10 in the heating chamber 19, as measured by the sensor 29 therein, is approximately 64 degrees Celsius. An example threshold value for the temperature of the container 20, as measured by the sensor 30 described above, is approximately 53 degrees Celsius. An example threshold value for the pressure in the container 20, as measured by the sensor 31 therein, is approximately 400 mbar. The control unit 6 may be configured to activate the heater 4 to heat the primary heating liquid 2 when all three of these temperature and pressure values are below the threshold values. An example threshold value for the temperature of the liquid primary heating fluid 2, as measured by the sensor 5 in the heating chamber 3, is approximately 80 degrees Celsius. In addition to the three measurements already discussed above, the measurement of the temperature of the liquid primary heating fluid 2 received from the sensor 5 in the heating chamber 3 may be checked against the threshold value by the control unit 6 before the control unit 6 is configured to activate the heater 4. The temperature measurements received from the sensor 5 in the heating chamber 3 may be used by the control unit 6 to keep the temperature of the liquid primary heating fluid 2 below the threshold limit, such as 80° C. All of the threshold values of the temperatures and pressures discussed above may be stored in the control unit 6 so that the control unit 6 can instruct the heater 4 to heat the liquid primary heating fluid 2 accordingly based on feedback from the sensors 5, 29, 30, 31 to maintain the desired temperature and pressure conditions.

The exit conduit 8 may be thermally insulated so that liquid heating fluid 2 flowing from the heating chamber 3 to the heat exchanger 9 does not lose any substantial amount of heat energy in the exit conduit 8. The temperature of the liquid primary heating fluid 2 arriving at the heat exchanger 9 may therefore substantially correspond to the temperature of the liquid heating fluid 2 leaving the heating chamber 3 through the chamber's exit 7.

As previously described, the heating surface 14 in the heat exchanger 9 is heated by the liquid primary heating fluid 2 and therefore its temperature is dependent upon that of the liquid primary heating fluid 2. This means that the temperature of the heating surface 14 does not rise above the temperature of the primary heating liquid 2 in the heat exchanger 9 and therefore the maximum temperature of the heating surface 14 is approximately equal to the boiling point of the primary heating liquid 2 in the heating chamber 3.

The heating chamber 3 in which the liquid primary heating fluid 2 is heated by the heater 4 is coupled via a pressure regulator 21 to the atmospheric pressure outside the chamber 3. The atmospheric pressure may be the natural atmospheric pressure of the Earth in the region of the apparatus 1. An example value of atmospheric pressure is approximately 101 kPa. As described below, the coupling between internal pressure of the heating chamber 3 and the atmospheric pressure outside the apparatus 1 causes the pressure regulator 21 to operate passively to prevent a substantial build-up of pressure in the heating chamber 3 and thereby prevent a substantial increase in the boiling point of the liquid primary heating fluid 2 in the chamber 3.

The pressure regulator 21 may comprise a pipe 22 in which a volume of liquid primary heating fluid 2 is present. As described below, under normal operating conditions of the apparatus 1, the liquid 2 in the pipe 22 seals the pipe 22 and thereby prevents gaseous transfer between the heating chamber 3 and the external atmosphere outside the apparatus 1. A consequence of this is that, under when the temperatures and pressures referred to above are below their threshold values, the liquid primary heating fluid 2 in the pipe 22 substantially prevents gaseous primary heating fluid 2 which has been evaporated from the liquid primary heating fluid 2 in the heating chamber 3 from escaping out of the apparatus 1 into the external atmosphere.

In more detail, referring to FIG. 1, the pipe 22 of the pressure regulator 21 comprises an inlet 23 and an outlet 24 located at opposing ends of the pipe 22. The inlet 23 is open to the primary fluid heating chamber 3. For example, the inlet 23 may be connected to a third aperture 25 of the heating chamber 3 previously discussed. The third aperture 25 of the heating chamber 3 is located in a wall 3*c* of the heating chamber 3. As shown in FIG. 1, the location of the third aperture 25 may be below the surface of the primary heating liquid 2 in the heating chamber 3 so that the primary heating fluid 2 in the heating chamber 3 is joined to liquid primary heating fluid 2 in the pipe 22 of the pressure regulator 21.

The outlet 24 of the pipe 22 of the pressure regulator 21 is open to the external atmosphere and hence atmospheric pressure outside the apparatus 1. Liquid primary heating fluid 2 is located in between the inlet 23 and the outlet 24, for example in a U-bend of the pipe 22, so that the liquid primary heating fluid 2 seals the inlet 23 of the pressure regulator 21 from the outlet 24 in the manner described above.

Referring again to FIG. 1, the pressure regulator 21 may, additionally or alternatively to the pipe 22, comprise a further outlet 26 which couples the pressure in the chamber 3 to the atmospheric pressure outside the apparatus 1. The further outlet 26 is configured to vent gaseous primary heating fluid 2 from the heating chamber 3 to the external atmosphere outside the chamber 3. The further outlet 26 may comprise an aperture 27 in the roof or wall of the heating chamber 3 and a seal 28, such as a lid, which is configured to seal the aperture 27 when the pressure inside the heating chamber 3 is below a predetermined threshold. If the pressure inside the heating chamber 3 rises above the predetermined threshold, the seal 28 is configured to automatically open and release gaseous primary heating fluid 2 from the chamber 3 into the external atmosphere. The predetermined pressure threshold value which causes the outlet 26 to open is higher than the value of atmospheric pressure outside the heating chamber 3 so that the gaseous primary heating fluid 2 automatically flows out of the chamber 3 through the aperture 27 when the seal 28 is broken. Optionally, once the pressure inside the heating chamber 3 has returned to a value below the predetermined threshold value, the seal 28 may be configured to close and thereby re-seal the aperture 27. Alternatively, the further outlet 26 may be configured so that re-sealing of the aperture 27 does not automatically occur. For example, repair or replacement work may be required. The seal 28 may be caused to open simply due to a natural, for example upward, opening force on the seal 28 caused by a difference between the internal pressure of the chamber 3 acting on a first side of the seal 28 and the external atmospheric pressure acting on an opposite, second side of the seal 28. Natural closure of the seal 28 may be caused by gravity when the pressures of the chamber 3 and external atmosphere have been substantially equalized.

If the temperature of the liquid primary heating fluid 2 in the heating chamber 3 increases above the defined upper threshold value referred to above, for example due to a malfunction in the heater 4, temperature sensors 5, 29, 30, pressure sensor 31 or control unit 6, then the rate of evaporation of the liquid primary heating fluid 2 in the chamber 3 increases above the rate which occurs at under normal operation. A consequence is a reduction in the amount of liquid primary heating fluid 2 in the chamber 3 and an increase in the amount of gaseous primary heating fluid 2 in the chamber 3.

As the liquid primary heating fluid 2 evaporates in the chamber 3, the surface of the liquid primary heating fluid 2 drops below the level of the heater 4 and thus the heater 4 ceases to directly heat the liquid primary heating fluid 2. Furthermore, as the volume of gaseous primary heating fluid 2 increases due to evaporation of the liquid heating fluid 2 in the heating chamber 3, the pressure regulator 21 ensures that a significant increase in the internal pressure of the heating chamber 3 is prevented by increasing the volume available for the gaseous primary heating fluid 2 to expand into. The pressure in the heating chamber 3 may primarily be reduced by venting of gaseous primary heating fluid 2 out of the chamber 3 through the further outlet 26 in the manner described above. The pressure in the heating chamber 3 may also be reduced by movement of the primary heating liquid 2 in the pipe 22, as described below.

If the pressure of the heating chamber 3 rises above the atmospheric pressure outside the heating chamber 3, force exerted by the gaseous primary heating fluid 2 against the liquid primary heating fluid 2 in the pipe 22 of the pressure regulator 21 causes the liquid primary heating fluid 2 inside the pipe 22 to move along the pipe 22 away from the inlet 23 and the heating chamber 3. This causes liquid primary heating fluid 2 to flow from the heating chamber 3 into the pipe 22 through the inlet 23 and thereby lowers the surface of the liquid primary heating fluid 2 in the chamber 3. The result is an increase in the volume of the chamber 3 available for the evaporated gaseous primary heating fluid 2 and thus a prevention of any substantial increase of pressure inside the heating chamber 3.

If the surface of the liquid primary heating fluid 2 inside the pipe 22 of the pressure regulator 21 is forced by the gas pressure to the level of the U-bend previously described, then gaseous primary heating fluid 2 evaporated from the liquid primary heating fluid 2 in the heating chamber 3 will begin to escape from the apparatus 1 by rising through the liquid primary heating fluid 2 on the outlet side of the U-bend in the pipe 22. This gaseous primary heating fluid 2 leaves the apparatus 1 and enters the external atmosphere outside the apparatus 1 via the outlet 24 of the pipe 22.

The two pressure regulating parts of the pressure regulator 21, namely the outlet 24 of the pipe 22 and the further outlet 26 act independently of each other. In an example operation, an increase of the pressure inside the heating chamber 3 above the threshold pressure value would initially cause the seal 28 of the further outlet 26 to open and vent gaseous primary heating fluid 2 to the exterior. Subsequently, evaporated heating fluid 2 may escape through the U-bend of the pipe 22. If either part of the pressure regulator 21 were to fail, pressure release in the chamber 3 would still occur via the other part.

For example, the outlet 24 of the pipe 22 of the pressure regulator 21 may be configured to act as a back-up mechanism for releasing pressure from the heating chamber 3 in the event that the further outlet 26 of the pressure regulator 21 fails to do so. The opposite may also be true in the case of failure of the pipe 22.

The pipe 22 may be formed from glass or otherwise transparent material so that the level of liquid primary heating fluid 2 in the pipe 22 can be visually monitored from outside the apparatus 1. If it is observed that the level of liquid 2 on the outlet side of the U-bend in the pipe 22 has risen above the normal level, it indicates that primary liquid heating fluid 2 has been forced along the pipe 22 towards the outlet 24 by a build-up of pressure in the chamber 3. An operator of the apparatus 1 may then choose to manually shut down the heater 4.

Additionally or alternatively, the material from which the pipe 22 is formed may be relatively brittle and/or fragile so that a seismic event such as an earthquake causes the pipe 22 to break and release liquid primary heating fluid 2 from the chamber 3 via the third aperture 25. The release of liquid 2 in this manner may cause the surface of the liquid 2 in the chamber 3 to drop below the heater 4 so that the heater 4 no longer heats the liquid 2. Breakage of the pipe 22 may also allow free gaseous transfer between the external atmosphere and the chamber 3.

As described above, the pressure regulator 21 prevents a substantial increase of pressure inside the heating chamber 3 above the atmospheric pressure outside the chamber 3. In doing so, the pressure regulator 21 prevents the boiling point of the liquid primary heating fluid 2 inside the heating chamber 3 from rising significantly above the boiling point of the liquid 2 at normal atmospheric pressure of approximately 101 kPa. Accordingly, even if a malfunction occurs which causes the liquid primary heating fluid 2 inside the heating chamber 2 to boil, the maximum temperature to which the primary heating fluid 2 may heat the heating surface 14 is approximately the boiling temperature of the liquid primary heating fluid 2 at the atmospheric pressure outside the apparatus 1.

To give a specific example, if the primary heating fluid 2 is water, the maximum temperature of the heating surface 14 in the heat exchanger 9 is approximately one hundred degrees Celsius. It follows that the maximum temperature of the secondary heating fluid 10, and uranium material container 19, is also approximately one hundred degrees Celsius. The apparatus 1 therefore prevents the uranium material container 19 from being heated to undesirably high temperatures, even in the case that the apparatus 1 suffers a malfunction.

Figure 4:
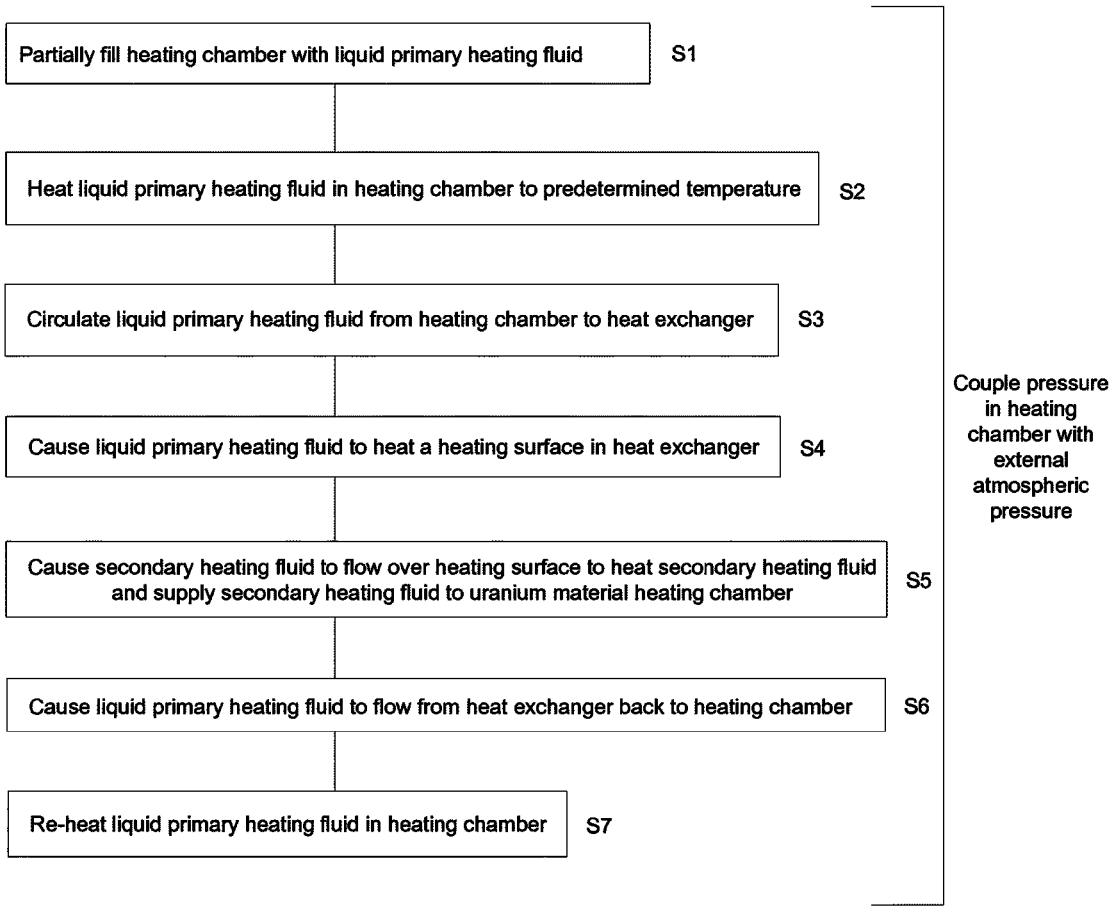
FIG. 4 is a flow diagram of a method of heating a primary heating fluid and transferring heat from the primary heating fluid to a secondary heating fluid to heat a uranium material container.

A method for heating the uranium material container 20 by heating the primary and secondary heating fluids 2, 10 is described below with reference to FIG. 4.

In a first step S1 of the method, the heating chamber 3 is partially filled with liquid primary heating fluid 2. The liquid primary heating fluid 2 is referred to below as water 2, but it will be appreciated that alternative evaporable liquid heating fluids 2 could be used and that the method is not limited to the use of water. If water is used, a quantity of olive oil may be added to reduce evaporation. The chamber 3 is filled with water 2 to a level which at least partially submerges the heater 4 in the heating compartment of the chamber 3. Filling of the chamber 3 may be carried out using the fill line previously described. Alternatively, the chamber 3 may be filled by removing a lid of the chamber 3 and re-fixing the lid once the chamber 3 has been filled to the desired level. A drain line may be used if the chamber 3 has to be emptied. Filling of the chamber 3 may also cause water to flow into the pipe 22 through the aperture 25 so that water 2 rests in the U-bend of the pipe 22. As illustrated in FIG. 1, the volume of the water 2 added to the pipe 22 is such that a separate surface of the water 2 is present on each side of the U-bend. The U-bend is full of water 2 and, accordingly, sufficient water 2 is present to seal the pipe against the escape of gaseous primary heating fluid 2 from the chamber 3. As previously described, the pipe 22 may be formed of glass or otherwise transparent material so that the level of the water 2 on each side of the U-bend can be clearly observed from outside the apparatus 1.

In a second step S2, the heater 4 is activated and begins to heat the water 2 inside the heating chamber 3. The temperature to which the water 2 is heated is regulated by the controller 6 based on temperature and pressure signals received from the sensors 5, 29 30, 31 in the heating chambers 3, 19 and container 20 respectively, as previously described.

In a third step S3, the water 2 is circulated from the heating chamber 3 to the heat exchanger 9. The pump 11 may be activated, for example by the controller 6 based on data received from the sensors 29, 30, 31 in the heating chamber 19 and the container 20, to aid this process.

In a fourth step S4, the water 2 from the heating chamber 3 heats the heating surface 14 in the heat exchanger 9. The heating surface 14 may, for example, comprise one or more thermally conductive fins arranged to receive heat from the water 2 via a thermal coupling, as previously described.

In a fifth step S5, the secondary heating fluid 10, which may comprise air, flows over the heating surface 14 and is thereby heated. The secondary heating fluid 10 may optionally be blown over the heating surface 14 by one or more fans in the heat exchanger 9. The heated secondary heating fluid 10 is then directed away from the heat exchanger 9 via a thermally insulated path to heat the uranium material heating chamber 19 and container 20 therein. For example, the secondary heating fluid 10 may be circulated in a continuous manner from an exit of the heat exchanger 9 to an entry of the heat exchanger 9 via the uranium material heating chamber 19.

In a sixth step S6 of the method, the water 2 is caused to exit the heat exchanger 9 and flow back into the liquid receiving compartment of the heating chamber 3.

In a seventh step S7, the water 2 overflows an internal wall 3*d* of the heating chamber 3 and re-enters the heating compartment of the heating chamber 3. Here, the water is re-heated by the heater 4 before being caused to flow back to the heat exchanger 9 to further heat the secondary heating fluid 10.

As previously described, the pressure regulator 21 acts throughout the heating process to prevent a substantial build up of pressure in the heating chamber 3 and thereby prevent the water 2 from boiling at a temperature substantially above one hundred degrees Celsius, assuming an external atmospheric pressure of 101 kPa. Boiling of the water 2 in the heating chamber 3 causes the water 2 to evaporate to such an extent that the water level falls below the level of the heater 4. This substantially prevents any further heating of the secondary heating fluid 10 in the heat exchanger 9 due to the lack of heated water being circulated in the apparatus 1. As such, the temperature of the uranium material container 20 is prevented from rising to an undesirable level.

The alternatives described above may be used either singly or in combination.

The invention claimed is:

1. A heating apparatus arranged to heat a uranium material container, comprising:

a heating chamber in which a heater is configured to heat a heating liquid;

a heat exchanger configured to receive the heating liquid from the heating chamber and to transfer heat energy from the heating liquid to a separate heating fluid;

a separate uranium material heating chamber having a uranium material container situated therein, wherein the apparatus is configured to direct heated heating fluid from an exit of the heat exchanger to an entrance of the uranium material heating chamber and to heat the uranium material container with the heated heating fluid; and a pressure regulator configured to control a pressure inside the heating chamber, wherein the regulator is coupled at a first side to a pressure in the heating chamber and at a second side to atmospheric pressure outside the apparatus, wherein the pressure regulator comprises:

an inlet open to the heating chamber and an outlet open to atmospheric pressure outside the apparatus; and a U-bend between the inlet and outlet for containing a body of liquid heating fluid; and wherein the heater is positioned above the pressure regulator inlet and the apparatus is configured so that evaporation of the heating liquid in the heating chamber pushes heating liquid into the U-bend and lowers a surface of the heating liquid in the heating chamber below the heater.

2. An apparatus according to claim 1, wherein the pressure regulator comprises a seal which is configured to be automatically opened by a pressure differential between the pressure in the heating chamber and the atmospheric pressure outside the apparatus, thereby opening a channel between the heating chamber and the atmosphere outside the apparatus.

3. An apparatus according to claim 1, wherein a difference between the pressure inside the heating chamber and the atmospheric pressure outside the apparatus causes the heating liquid to flow from the heating chamber through the inlet towards the outlet.

4. An apparatus according to claim 1, wherein the heat exchanger comprises a heating surface which is thermally coupled to a heating liquid channel to receive heat from the heating liquid.

5. An apparatus according to claim 4, wherein the heat exchanger comprises a heating fluid channel configured to direct the heating fluid over the heating surface to receive heat from the heating surface.

6. An apparatus according to claim 1, wherein the apparatus is configured to return cooled heating fluid from the uranium material heating chamber to the heat exchanger as part of a closed loop.

7. An apparatus according to claim 1, wherein the heating liquid comprises water and the heating fluid is air.

8. An apparatus according to claim 1, wherein evaporation of the heating liquid in the heating chamber prevents further heating of the heating liquid and heating fluid.

9. An apparatus according to claim 1, wherein evaporation of the heating liquid in the heating chamber lowers a surface of the heating liquid below the heater and thereby prevents direct contact between the heating liquid and the heater.

10. A method of heating a uranium material container, comprising:

heating a heating liquid in a heating chamber in which a heater is configured to heat the heating liquid;

receiving the heating liquid in a heat exchanger and transferring heat energy from the heating liquid to a separate heating fluid, wherein the heat exchanger is configured to receive the heating liquid from the heating chamber and transfer heat energy from the heating liquid to the heating fluid;

directing heated heating fluid, in an apparatus comprising the heating chamber, the heat exchanger, a pressure regulator, and a separate uranium material heating chamber, from an exit of the heat exchanger to an entrance of the uranium material heating chamber, wherein the separate uranium material heating chamber has a uranium material container situated therein, wherein the apparatus is configured to direct heated heating fluid from an exit of the heat exchanger to an entrance of the uranium material heating chamber and to heat the uranium material container with the heated heating fluid;

heating the uranium material container situated in the uranium material heating chamber with the heated heating fluid; and regulating a pressure inside the heating chamber by coupling a pressure in the heating chamber to atmospheric pressure outside the apparatus via the pressure regulator, wherein the regulator is configured to control a pressure inside the heating chamber, wherein the regulator is coupled at a first side to a pressure in the heating chamber and at a second side to atmospheric pressure outside the apparatus, wherein the pressure regulator comprises:

an inlet open to the heating chamber and an outlet open to atmospheric pressure outside the apparatus; and a U-bend between the inlet and outlet for containing a body of liquid heating fluid;

wherein the heater is positioned above the pressure regulator inlet and the apparatus is configured so that evaporation of the heating liquid in the heating chamber pushes heating liquid into the U-bend and lowers a surface of the heating liquid in the heating chamber below the heater.

11. A method according to claim 10, wherein evaporation of the heating liquid prevents further heating of heating liquid and heating fluid.

12. A method according to claim 11, wherein evaporation of the heating liquid in the heating chamber lowers a surface of the heating liquid below the heater in the heating chamber and thereby prevents direct contact between the heating liquid and the heater.

13. An apparatus according to claim 1, wherein the pressure regulator is configured to vent gaseous heating liquid from the heating chamber upon a pressure in the heating chamber reaching a predetermined value.

14. An apparatus according to claim 1, wherein the pressure regulator is configured such that a difference between the pressure inside the heating chamber and the atmospheric pressure outside the apparatus causes the pressure regulator to open to vent evaporated gaseous heating liquid from the heating chamber.

15. An apparatus according to claim 1, wherein the apparatus is configured to direct heated heating liquid from the heating chamber, to the heat exchanger, and back to the heating chamber.

16. An apparatus according to claim 15, wherein the apparatus is configured to return cooled heating fluid from the uranium material heating chamber to the heat exchanger as part of a closed loop.

* * * * *